US006905573B2

(12) United States Patent
Mäenpää et al.

(10) Patent No.: US 6,905,573 B2
(45) Date of Patent: Jun. 14, 2005

(54) METHOD AND EQUIPMENT FOR CLEANING AND MAINTAINING ROLLS

(75) Inventors: Tapio Mäenpää , Helsinki (FI); Timo Vuorimies, Järvenpää (FI); Pekka Koivukunnas, Järvenpää (FI); Aaron Mannio, Järvenpää (FI); Olli-Pekka Väkevä , Pori (FI); Kari Hasanen, Kerava (FI); Tarja Hanska, Tampere (FI); Pekka Linnonmaa, Järvenpää (FI); Markku Kyytsönen, Numminen (FI); Helena Leppäkoski, Järvenpää (FI); Markus Laitila, Järvenpää (FI); Markku Kojo, Espoo (FI); Toni Seppänen, Kerava (FI); Marjaana Toppila, Vantaa (FI)

(73) Assignee: Metso Paper, Inc., Helsinki (FI)

( * ) Notice: Subject to any disclaimer, the term of this patent is extended or adjusted under 35 U.S.C. 154(b) by 28 days.

(21) Appl. No.: 10/363,799

(22) PCT Filed: Sep. 6, 2001

(86) PCT No.: PCT/FI01/00775

§ 371 (c)(1),
(2), (4) Date: Jun. 23, 2003

(87) PCT Pub. No.: WO02/20901

PCT Pub. Date: Mar. 14, 2002

(65) Prior Publication Data

US 2004/0035540 A1 Feb. 26, 2004

(30) Foreign Application Priority Data

Sep. 6, 2000 (FI) ..... 20001966
Sep. 12, 2000 (FI) ..... 20002001
Sep. 12, 2000 (FI) ..... 20002002

(51) Int. Cl.[7] ..... D21F 1/32; D21G 1/00; D21G 9/00

(52) U.S. Cl. ..... 162/199; 162/198; 162/252; 162/253; 162/262; 162/263; 162/272; 700/128; 134/9; 134/18

(58) Field of Search ..... 162/198, 199, 162/263, 255, 272–279, 281, DIG. 6, DIG. 10, DIG. 11; 700/127–129; 15/256.5, 256.51; 134/9, 18; 101/425, 484

(56) References Cited

U.S. PATENT DOCUMENTS 4,781,116 A * 11/1988 Harada ..... 101/425
4,852,209 A * 8/1989 Svenka et al. ..... 15/308

(Continued)

FOREIGN PATENT DOCUMENTS

DE 195 39 015 A1 10/1996
DE 199 18 011 A1 10/2000

(Continued)

OTHER PUBLICATIONS

Search Report issued in Finnish Priority Application No. 20001966.

(Continued)

*Primary Examiner*—Eric Hug
(74) *Attorney, Agent, or Firm*—Stiennon & Stiennon

(57) ABSTRACT

The surface of a web is monitored by a fault detection system (20), a machine condition monitoring system, a quality measurement system, a web moisture measurement and/or a web temperature measurement and the soiled part of the surface of the roll is detected and localized by means of a soiling monitoring apparatus (31, 35; 60). A control system (41) controls a cleaning device (40) to remove the detected soiling. As a web (W) travels in a paper or board production or finishing process or in finishing machinery the web and/or the surface of the roll is monitored and after a detected deviation the surface thereof is momentarily spread with a liquid while machinery is running at the same time as the web (W) travels over said roll surface.

53 Claims, 9 Drawing Sheets

U.S. PATENT DOCUMENTS

| | | | | | |
|---|---|---|---|---|---|
| 4,930,415 | A | * | 6/1990 | Hara et al. | 101/228 |
| 5,021,124 | A | | 6/1991 | Turtinen et al. | |
| 5,032,229 | A | | 7/1991 | Boucher | |
| 5,080,015 | A | * | 1/1992 | Hansson et al. | 101/483 |
| 5,524,805 | A | * | 6/1996 | Shiba et al. | 226/108 |
| 5,553,546 | A | * | 9/1996 | Hoff | 101/483 |
| 5,685,955 | A | | 11/1997 | Leigraf et al. | |
| 6,143,092 | A | * | 11/2000 | Straub et al. | 134/15 |

FOREIGN PATENT DOCUMENTS

| | | | | | |
|---|---|---|---|---|---|
| EP | 0 654 560 A2 | | 5/1995 | | |
| FI | 83347 | | 3/1991 | | |
| FI | 910304 | | 7/1992 | | |
| FI | 974255 | | 11/1997 | | |
| WO | WO 98/46826 | | 10/1998 | | |
| WO | WO 99/20836 | | 4/1999 | | |
| WO | WO 99/25921 | | 5/1999 | | |
| WO | WO 99/36616 | * | 7/1999 | | D21G/1/00 |
| WO | WO 02/20901 | | 3/2002 | | |

OTHER PUBLICATIONS

Search Report issued in Finnish Priority Application No. 20002001.

Search Report issued in Finnish Priority Application No. 20002002.

International Search Report issued in International Application No. PCT/FI01/00775.

International Preliminary Examination Report issued in International Application No. PCT/FI01/00775.

* cited by examiner

METHOD AND EQUIPMENT FOR CLEANING AND MAINTAINING ROLLS

CROSS REFERENCES TO RELATED APPLICATIONS

This application is a U.S. national stage application of International Application No. PCT/FI01/00775, filed Sep. 6, 2001, and claims priority on Finnish Application Nos. 20001966, filed Sep. 6, 2000; 20002001 filed Sep. 12, 2000; and 20002002 filed Sep. 12, 2000, the disclosures of each application are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method and equipment for cleaning and maintaining the rolls of paper or board machines, and especially the rolls of finishing equipment.

Calendars comprise two or more hard and/or soft-surfaced calender rolls, which together form a calender nip or nips through which the paper web to be treated is made to pass. Calender rolls, especially soft-surfaced rolls such as a super-calender's paper rolls or corresponding, and rolls equipped with a so-called soft calender's soft cover, especially a polymer cover, are sensitive to damage. The cause of damage is often impurities, such as local fiber agglomerations, that cause a pressure impact while passing through the nip, which loads the soft cover of the calender roll causing it first to heat (the so-called hot spot phenomenon) and in time causing permanent deformation of the cover and damage. Corresponding deformations and damage can also appear in metallic calender roll surfaces and in the surfaces of belts that pass through the calendering nips.

The damage-induced heating of a calender roll is especially harmful for rolls with polymer covers. Due to the polymer's large heat expansion coefficient and extremely poor heat conductivity, even a small damaged area expands quickly and continues to heat to such high temperatures that it becomes deformed. If a covered roll is made of thermosetting resin, it loses its original properties at the same time as it melts again. The above-described heating reaction can be triggered, for example, by a small piece of paper stuck on the surface of the roll, a fiber agglomeration or a spot released from a paper or board cover which, when it enters a calender nip, causes greater flex than in its immediate surroundings in the cover, which heats the roll cover unevenly.

The prevention of local soiling by, for example, continuous doctoring is not usually feasible financially or with respect to the best quality of the paper or board, because most of the polymer covers in use are not very friction-resistant, so that preventive cleaning may itself wear out the cover more than the actual calendering.

If soiled areas could be detected early enough, it would be possible to use, for example, a cleaning doctor or other device for cleaning the roll surface for short periods without the roll cover being damaged by continuous or often repeated doctoring. Thus, the operating life of soft-surfaced calender rolls could be notably lengthened.

As is already known, thermometers traversing in a cross-wise direction with respect to the machine, that monitor the temperature of the cover, are used to monitor the condition of calender rolls, especially soft-surfaced rolls. Problems arise in the said temperature monitoring application and in other corresponding already-known systems, due to the fact that the flexible roll cover whose temperature is being monitored is usually at least somewhat dielectric. Thus, the partially frictional contact between the paper web and the cover produces quite high charges of static electricity on the surface of the cover and the somewhat dry paper web. These potential differences attempt to discharge through the available routes of smallest resistance. The thermograph often has to be installed externally in the support structure, in which case the said charges of static electricity find the thermograph to be the easiest outlet for discharge, thus causing the sensitive electronics of the thermograph to be exposed to quite high voltages and to require protection against them.

Even though monitoring the temperature of the calender roll surface usually makes it possible to detect excessive loading on the cover or a local temperature rise due to local internal non-homogeneity at a sufficiently early stage, it requires installation of quite heavy, expensive and space-taking equipment in the proximity of the roll to be monitored. Especially the lack of space causes great difficulties in connection with multi-roll finishing equipment, in which each device that is not part of the actual paper web finishing process complicates maintenance and repair of the equipment.

Another known method of detecting the soiling of a calender roll surface is a measuring method based on roll vibration, which is presented in the applicant's patent application FI 974255. In this method, one or more vibration sensors that indicate and localize the vibration point caused by soiling are inserted in the calender roll structure. Soiling can also be detected by a fault detection system that monitors the state of the paper web. This system detects holes and coating color streaks in the paper web. Other known systems that detect roll soiling include a machine condition monitoring system, a quality measurement system, web moisture measurement and the above-explained web temperature measurement.

When the soiling of a roll has been detected, an attempt is made to remove the soiling as quickly as possible to prevent damage to the surface of the roll and to minimize the amount of rejected product. Most commonly, the dirt is removed by using a conventional blade doctor, in which the doctoring blade extends for the whole length of the calender roll and usually continuously removes, i.e. doctors, the soiling and impurities. Other known doctoring methods include a washing doctor that directs a liquid jet on the soiled part, and a flow doctor that directs an air jet on the part to be cleaned. A set of calender rolls can also be supplemented with a cleaning nip, which removes the worst coat weight deviations that come with the paper web before they are transferred to the set of calender rolls.

The problem of the conventional blade doctor is that the doctoring function is applied to the roll surface continuously, which leads to unnecessary wearing of the roll, thus shortening the roll's operating life.

SUMMARY OF THE INVENTION

The purpose of the invention disclosed herein is to create a new method and equipment for cleaning and maintaining the rolls of paper or board machines, and especially the rolls of finishing equipment.

A special goal of the invention is to create a new method and equipment, with which the soiling of finishing equipment rolls is detected by on-line measurement and an immediate doctoring operation is applied to the soiled part.

The purpose of the invention is also to present a simpler method for roll surface maintenance, which method can be used to maintain the different rolls in paper or board production and finishing processes while the roll is running in the process.

In addition, the purpose of the invention is to present an efficient method by means of which the condition of finishing equipment rolls can be monitored especially in on-line calendering after the coating station, and perform efficient maintenance during operation of the calender at the same time as the paper web is run through the calender. The invention is also suitable, however, for use in off-line calendering if maintenance problems occur in it.

An additional purpose of the invention is to create a new method and equipment in which the doctoring operation is performed for several rolls by a common doctor actuator.

The method that is the object of the invention aims at the rapid localization and removal of dirt particles, coating color streaks and other impurities traveling with the web before they enter the nip of the finishing equipment rolls, for example, the calender. Thus the expensive damaging of roll covers can be prevented. The method attempts especially to prevent roll damage in on-machine applications, in which the calender is located after the coating machine.

In the method according to the invention the soiling of the finishing equipment rolls, for example a calender roll, is detected and localized by a known method, such as a measurement based on roll vibration, information given by a fault detection system, a thermograph measurement, information obtained from a condition monitoring system or other known method, or alternatively by the new method presented in this application in which soiling is detected and localized by measurement based on laser radiation.

An advantageous embodiment of the invention is based on the notion that the soiling of the roll in contact with the paper web, for example in a coating station or calender, can be prevented by spraying liquid momentarily on the surface of the web before it comes into contact with the roll and/or on the surface of the roll when a deviation is detected on the surface of the web or the roll. A deviation on the surface of the web, for example a hole, can cause an extra substance agglomeration on the web or roll, or, an extra substance agglomeration, for example extra coating color on the web or soiling of the roll surface, has already occurred in fact. The liquid can prevent extra substance agglomerations in advance, or extra substances such as extra amounts of coating color end up in the web due to the liquid. The part of the paper web which contains the liquid sprayed on the web or the roll is in most cases removed as broke.

According to the invention disclosed herein, the soiling is removed by a new kind of doctoring method in which the actuator of the doctor operating as a cleaning device is directed to clean only the detected soiled part of the roll. The cleaning device is controlled by the information obtained from the soiling detection and localization system. For example, a blade doctor extending the whole length of the roll a zone doctor of limited length, a washing doctor, a blow doctor or a laser doctor according to the invention can be used as the cleaning device. In one advantageous embodiment of the invention, each side of the roll stack of a finishing machine, for example a multi-nip calender, has only one cleaning device, which is movable so that it is able to reach and clean all of the roll surfaces in turn.

A device according to one advantageous embodiment of the invention uses two doctor blades. A liquid that-prevents or reduces the sticking of dirt is sprayed between the doctor blades and/or before the first blade in the roll rotation direction. The liquid is sprayed continuously or at certain time intervals depending on how much dirt from the paper grade being run sticks onto the roll surface. If the roll needs only light cleaning, the doctor blades can be used separately as well as simultaneously, i.e. one blade can be out of use when the roll surface is being cleaned with the other blade.

The equipment can have a fault detection device which supplies information, on the basis of which both doctor blades are placed, if necessary, in the working position and the spraying of liquid is began, if it is not desired to keep the doctor blade and the feeding of liquid in continuous operation. Especially for faults coming from coating, both blades should be in use, because the coating color is relatively difficult to detach from the rolls.

The fault detection device consists of a detector device, which is arranged to monitor the soiling of the roll surface. The observations of the detector device go for processing to a data processing device, which gives an automatic operating command to the roll cleaning device when there is need for cleaning. The number of doctor blades taking a working position and/or the surface material of the doctor blade chosen for the work and/or the amount of liquid to be sprayed depends on the degree of soiling detected by the detector device. The fault detection device can also include other functions than the ones mentioned above.

The benefit of the invention disclosed herein is, for example, that a better and faster cleaning result is achieved using a doctor actuator according to the invention. Thus, the operating life of the calender rolls can be lengthened and the amount of broke caused by soiling can be reduced.

BRIEF DESCRIPTION OF THE DRAWINGS

The invention is described in more detail in the following with reference to the accompanying drawings, in which.

DESCRIPTION OF THE PREFERRED EMBODIMENTS

Figure 1:
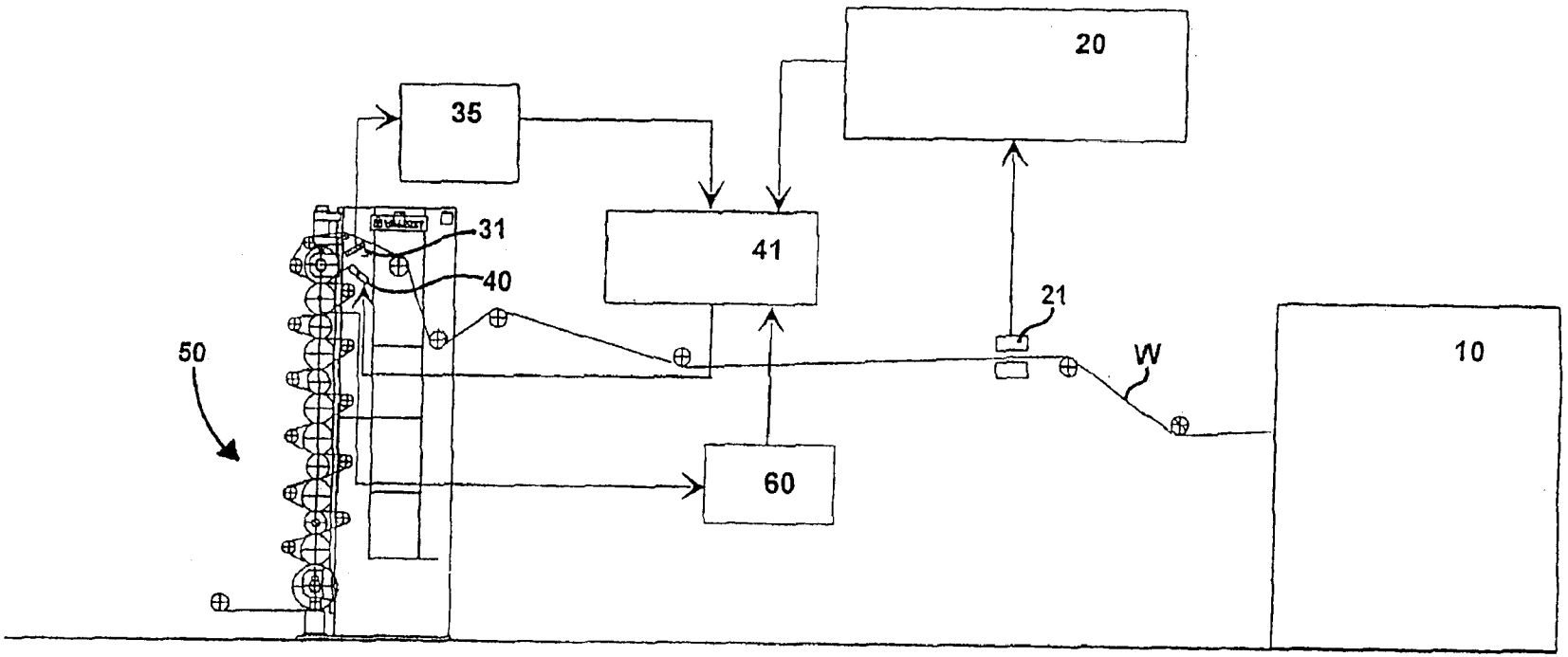
FIG. 1 presents a measuring and adjustment principle according to the invention.

FIG. 1 presents an example of an operating principle of an embodiment of the method according to the invention. In FIG. 1, the web W comes from the coating machine 10 and passes through the detector device 21 of the fault detection system 20 to the calender roll stack 50. The fault detection system 20 detects the holes and coating color streaks on the web W coming from the coating machine 10, and reports the detected faults to the control system 41 of the doctor actuator 40. Thus, soiling caused by coating color streaks and holes can be prevented and removed before the impurities move to the nip of the calender roll. The coating color streaks can be removed by, for example, a cleaning nip (not shown) located before the calender roll stack 50. Dirt particles that reach the surface of the rolls of the calender roll stack 50 are detected by the vibration measurement system 60, or by CCD camera measurement (not shown), or by thermograph measurement (not shown) or by soiling monitoring equipment which consists of a measuring unit 31 and a control unit 35.

The fault detection system 20, the soiling monitoring equipment 31, 35 or the vibration measurement system 60 gives information on the detected soiling, on the basis of which the doctor actuator's control system 41 activates the doctor actuator 40 which acts as a cleaning device. The activation takes into account different time delays which comprises, for example, measuring delays, electronics and software delays and the delay of the doctor actuator 40. In addition, the web velocity and the distance of the fault detection system 20 from the doctor actuator 40 is taken into account, thus determining the exact moment of time when the detected damage or dirt in the web will reach the calender roll stack 50.

On the basis of the information received from the fault detection system 20, the soiling monitoring equipment 31, 35 or the vibration measurement system 60, the detected soiling can be classified according to its degree of seriousness. The doctoring method to be used, the duration of doctoring and the adjustment of the controlling quantities of the doctor actuator can be chosen based on the classification, and thus the doctoring can achieve the best possible result with the fastest possible response time.

Figure 2A:
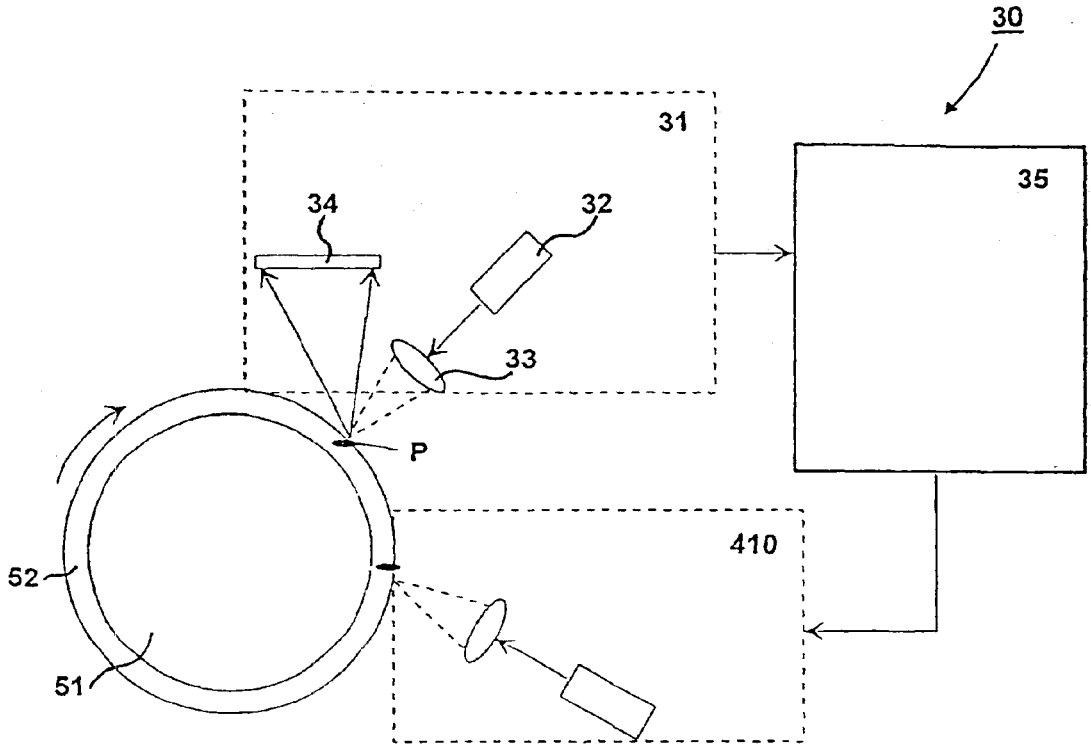
FIG. 2A shows the use of a laser detector according to the invention for indicating and detecting soiling.

FIG. 2A shows the detection of soiling by means of a laser measurement system 30 according to the invention. The laser measurement system 30 consists of the measuring unit 31 and the control unit 35. The measuring unit 31 comprises a laser light source 32, a lens 33, and a detector 34. A laser beam is directed from the laser light source 32 through the lens 33 onto the cover 52 of the roll 51, on which a dirt particle P is detected. Part of the laser beam is reflected from the dirt particle P on the cover 52 of the roll 51 onto detector 34, which gives information on the detected dirt particle P and its location to the control unit 35 of the laser measurement system 30. The control unit 35 analyzes the measurement signal received from the detector 34, carries out a power adjustment and direction steering with respect to the laser light source 32, and gives an alarm to the control system 41 of the doctor actuator 40. The doctor actuator 40 is, for example, the laser doctor 410 according to the invention presented in FIG. 2A, which is described further in FIG. 2B, or some other type of doctor actuator such as a blade doctor, a laundering doctor or a fan doctor. Doctor actuator 40 may comprise one doctor actuator or a combination of several doctor actuators.

The detecting and localizing of dirt particle P can be performed not only by detector 34, but also by a CCD camera, in which case a laser beam is swept over the roll surface and the changes appearing in the sweeping area, which indicate soiling, are detected by the CCD camera. The laser light source 32 of the measuring unit 31 of soiling monitoring equipment can be, for example, a HeNe laser whose advantage is a small divergence of the beam, a stable wavelength and a narrow spectrum. There can be one or more units monitoring the roll. The units can be fixed or movable. The units can be moved either by servomotors or by a pneumatic, hydraulic or mechanical actuator or mechanism. Alternatively, the laser beam can be aimed at different parts of the roll by using, for example, a robot and laser combination known from the car industry, with which a 3-dimensional operating area is possible.

Localizing dirt particle P by means of a laser beam can be based on different kinds of methods known as such. In measurements based on phase comparison, the radiation received from the laser light source is modulated, sent to the measurement object and the part returning from the object is detected by the detector. Based on the phase difference between the signal received from the receiver and the sent signal, it is possible to determine the distance traveled by the beam to the measurement object on the basis of multiples of the wavelength. In a triangle measurement, on the other hand, the laser light source, the object to be measured and the detector form a triangle, in which information on the shape of the surface, the distance and other properties is based on how the radiation sent to the surface is imaged on the surface of the detector. In this method, the surface being studied is swept with a narrow laser beam, in which case the path of the light point received from the detector combined with known measurement geometry provides information on the shape of the swept surface. The presence of soiling can be concluded from the detected unevenness of the surface.

Figure 2B:
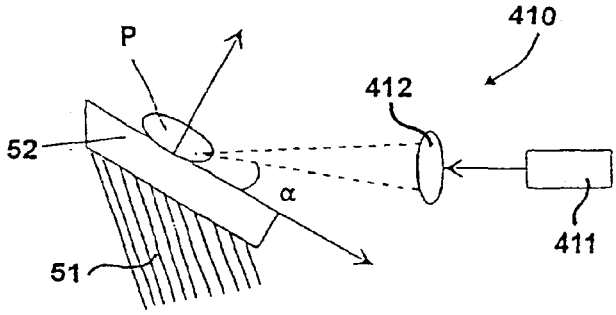
FIG. 2B presents the operating principle of a laser doctor according to the invention.

FIG. 2B shows an example of a doctor actuator operating as a cleaning device, which, in this example, is the laser doctor 410 according to the invention. In laser doctor 410 a laser beam of the laser light source 411 is aimed through lens 412 onto dirt particle P on cover 52 of roll 51, which dirt particle has been localized in the above-mentioned way. The laser beam is aimed at such an angle $\alpha$ onto the surface of the polymer roll that the radiation power to be absorbed by the dirt particle P is directed only at the dirt particles, and the heat wave of the laser beam penetrates only to a predetermined depth. The intensity, pulse duration and wavelength of the laser source 411 is adjustable. In state-of-the-art devices the area of influence of the laser beam can be aimed with at least $\pm 2$ $\mu$m precision, which is sufficient for this application, because the thickness of the dirt particles left on the roll surface is normally at least 100 $\mu$m. A laser doctor according to the invention is especially suitable for cleaning soft rolls with polymer covers. Because the polymer cover of a calender roll and the dirt particles found on it absorb electromagnetic radiation, in this case laser radiation, in a different way, the laser radiation can be aimed to affect selectively only the dirt particles, in which case the polymer cover of the roll is not harmed.

Figure 3A:
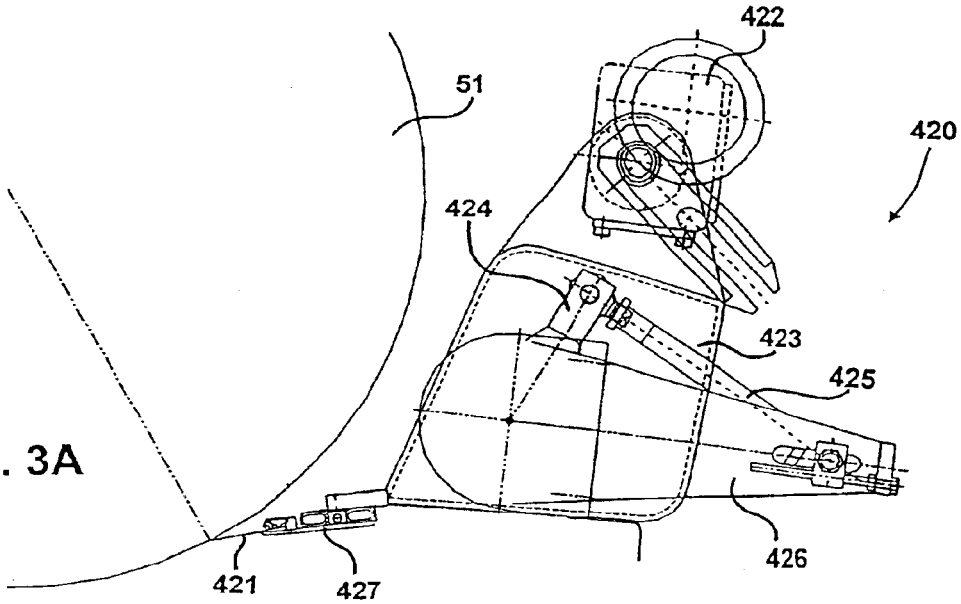
FIG. 3A presents a control mechanism according to one embodiment of a blade doctor according to the invention.

FIG. 3A presents an example according to the invention of a second embodiment of a doctor actuator operating as a cleaning device. Doctor actuator 420 consists of a doctor blade 421, oscillating device 422, frame part 423, support mechanism parts 424, 425, 426 and the adjustment mechanism of the doctor blade 427. The motion of the doctor blade 421 of the doctor actuator 420 in the direction of the tangent of the surface of the roll 51 to be doctored or in the direction of the roll radius is carried out by means of a servomotor or electromagnet, or alternatively by means of a pneumatic, hydraulic or mechanical actuator or mechanism. The motion of the blade 421 can also be carried out by using a magnetostrictive material in either the blade or the support structures of the blade.

Figure 3B:
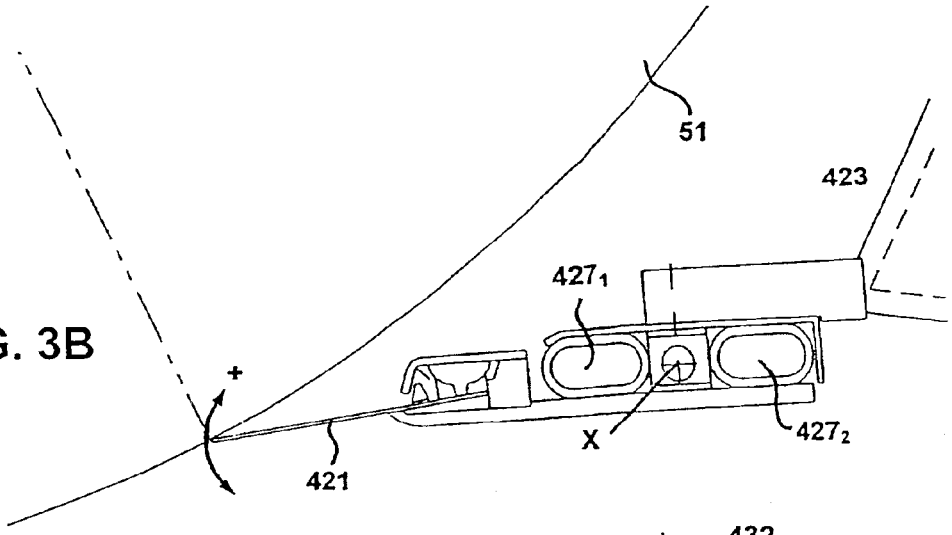
FIG. 3B presents a control mechanism according to a second embodiment of a blade doctor according to the invention.

FIG. 3B presents a detail of the adjustment mechanism of the doctor blade 421 presented in FIG. 3A. In this embodiment, the short motion of the doctor blade 421 is carried out, with respect to support point X, by controlling the pressures in chambers $\mathbf{427}_1$ and $\mathbf{427}_2$, which are formed from, for example, a hose. In addition, by controlling the chamber pressures it is possible to adjust the doctoring pressure, i.e. the force that the doctor blade 421 exerts on the roll cover.

Figure 3C:
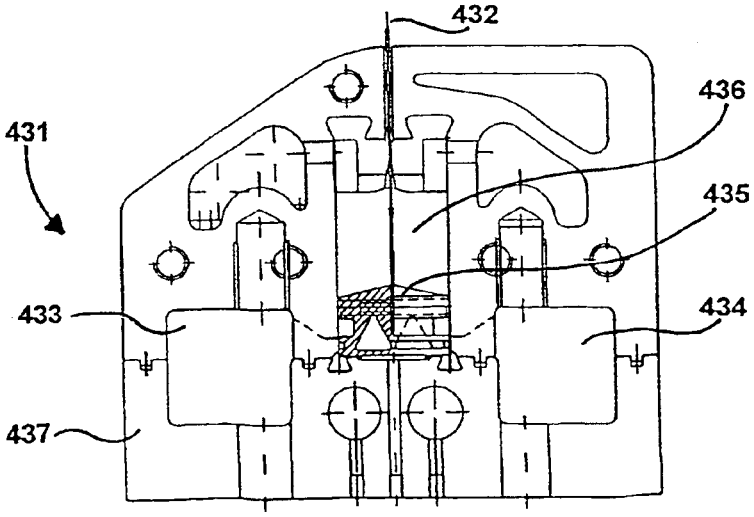
FIG. 3C presents a control mechanism according to a third embodiment of a blade doctor.

FIG. 3C presents an example in which the length of the doctor blade 432 is adjusted to create the motion of the doctor blade in the direction of the tangent of the roll surface. The doctor mechanism 431 consists of a doctor blade 432, air containers 433, 434, piston 435, cylinder 436 and frame part 437. With precise control of the motion and stroke length of the doctor blade and the correct choice of doctor blade material, the doctoring can be performed without damaging the polymer cover. Because air containers 433, 434 are situated in the immediate proximity of the piston 435, the doctor blade 432 can be moved fast.

The mechanical structure of the doctor actuator operating as a cleaning device ensures that when the doctor actuator is in the ready position it can be moved quickly enough to the working position, i.e. in contact with the surface to be doctored. For example, when the doctor actuator comprises pneumatic actuators, then the working cylinder, hose or other corresponding actuator can be pre-pressurized, in which case, on the basis of the information received from the soiling monitoring device equipment 31, 35 or the fault detection system 20, the rapid magnetic valve is opened/closed.

Figure 4:
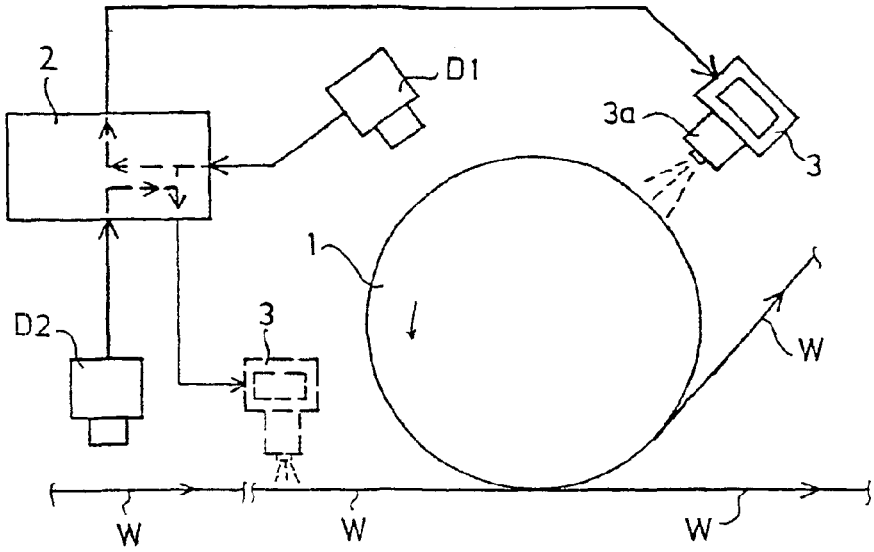
FIG. 4 presents the principle of the method according to the invention as a side view of the equipment handling the paper web.

FIG. 4 presents the principle of implementing a method according to the second embodiment of the invention as a side view of the web handling equipment. Web W is in contact with roll 1, either by passing over it in a certain sector or by touching one point of the roll's outer shell (broken line). The former case may concern, for example, the counter roll of a coating station which, from the back side, guides the web before coating color is spread on the outer surface of the web at the roll by some coating method. An example of the latter case is a calender in which web W can be in contact, at minimum, only at the point where it is pressed between roll 1 and the opposite roll in the calender nip. Thus, both cases concern a station in which a surface treatment for finishing a web made of fiber stock—the treatment being coating in the former case and calendering in the latter case—is performed on a continuous web arriving from previous treatment phases and usually moving at a running velocity of over 1000 m/min.

Due to substances coming mainly with the web, but also possibly from elsewhere in the environment, extra substances may remain on the surface of roll 1. These substances can be detected by a detector device D1 that inspects the surface of the roll, the alternatives of which are presented hereinafter. It is also possible that already earlier such deviations are detected in web W that will cause problems at a point or area where the web W will come in contact with the surface of roll 1. This detector device, which is to be located a sufficient distance before roll 1 in the running direction of the web, is indicated with the reference indicator D2. In FIG. 4, the spraying device 3 is situated before the detector D1 in the rotation direction of the roll, but it can also be situated after the detector D1.

The observations of detector device D1 or D2 are processed in the data processing device 2, which automatically gives the operating command to spraying device 3 to clean the surface of roll 1 or to prevent soiling (sticking of extra substances). Spraying device 3 can spray liquid for a sufficiently long time onto the part of the shell of roll 1 that is not covered by web W, with the result that the extra substance agglomerations detach from the roll surface under the influence of the liquid, or their adhesion to the roll surface decreases to the extent that, when they come into contact with web W, they stick to the web. Web W thus operates as a kind of "cleaning felt", by which the roll surface can be cleaned, and the part of the web which is thus used for cleaning purposes can later be removed as broke. It is also possible that the sticking of foreign substances on the roll from the web can be prevented, depending on the type of substance and the liquid. Thus, the detector device D2, situated before the roll, is used so that such operations can be begun before the substance reaches the roll.

According to the second alternative, presented by a broken line in FIG. 4, the liquid can be sprayed from spraying device 3 before roll 1 onto that surface of web W that comes into contact with the roll shell, in which case the dampened web is able to take with it the extra substances stuck onto it from the surface of the roll, and this part of the web can later be removed as broke. Thus, the operation of spraying device 3 is determined according to the observations of detector device D1 monitoring the surface of roll 1.

In addition, it is possible that the cleaning liquid sprayed on the surface of the web is of such type that it prevents the substance on the web from sticking to the surface of the roll. Thus, the detector D2, situated before the roll and the spraying point, is used as the detector.

The process control system can be used to determine which part of the web is now broke due to the liquid addition, and in which location the said part of the web is moving, so that it can be removed.

It is also possible that the cleaning by spraying is performed as a routine operation at certain phases of the finishing process of paper and board, for example, when the product will become broke in any case. In this case, the detector devices are not necessarily used, but the spraying is performed by the command of the production process control system, irrespective of whether there are extra substances on the roll surface or not. Thus, the finishing process control system can give the command for cleaning suitably timed for a certain process phase, such as during a roll change or a grade change. Another alternative is to time the cleaning to be performed according to a previously determined schedule, for example, at certain time intervals.

It is also possible that cleaning in a certain predetermined phase or during a certain predetermined moment of time is performed only if the detector device D1 monitoring the roll surface detects that there is a need for it. Thus, the cleaning command can be confirmed by comparing it to the information given by the detector device D1.

Figure 5:
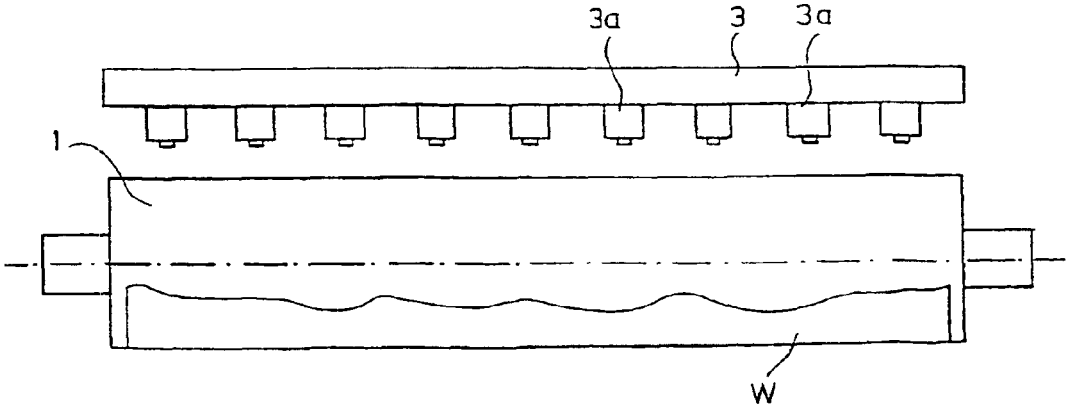
FIG. 5 presents the principle as a cross-section across the running direction of the web.

FIG. 5 presents the situation in FIG. 4 seen as a plan view of the situation opposite the shell of roll 1. Here, mainly the various alternatives of how to carry out the spraying are presented. As spraying device 3 is able to spray along the whole width of web W or length of roll 1, it may consist of a series of nozzles 3*a* placed side-by-side which cover the whole width of the web or one traversing nozzle that is able to spray along the whole width of the web by moving across the machine. Full-width spraying is performed when it is desired to clean roll 1 as a routine procedure, i.e. during suitable stages of paper or board finishing processes or at certain time intervals according to the above-mentioned principle. The conduits for bringing the liquid to the nozzle/nozzles 3*a* are not presented as they can be implemented and the spraying can be controlled (activated/stopped) by known solutions.

The spraying devices in FIG. 5 can also spray only part of the web width, in which case all the nozzles 3*a* are not in operation, but the spraying is performed only in a certain place by one or several nozzles 3*a* situated across the machine, depending on the location of the problem point. With a traversing spraying device 3, this is done by moving the nozzle across the machine to the corresponding point.

Figure 6:
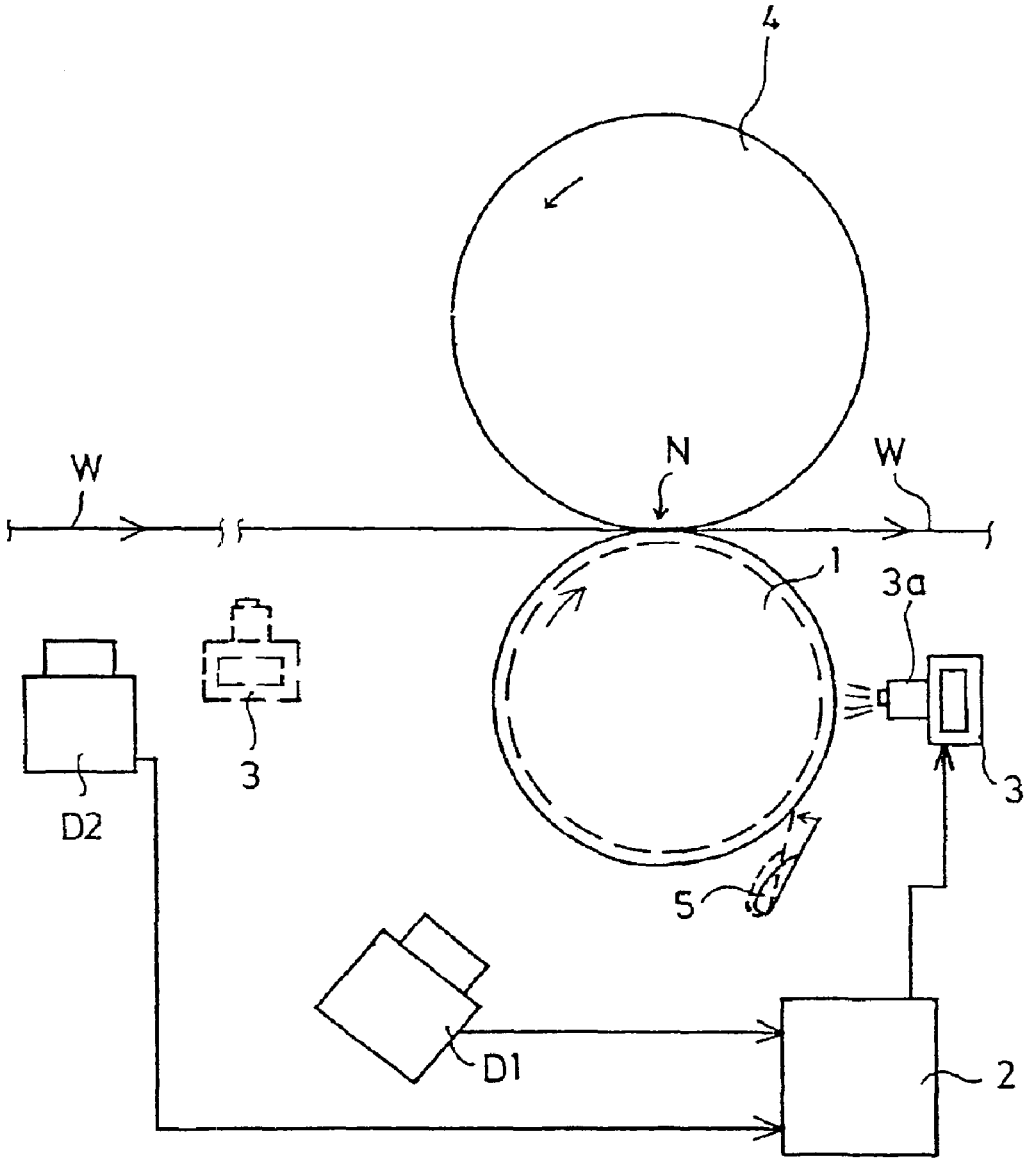
FIG. 6 presents one embodiment of the invention as a side view in connection with the calender.

FIG. 6 presents the application of a spraying method according to the invention in connection with a calender. The calender roll 1 to be cleaned is a so-called soft roll with a polymer surface and the web passes through calender nip N between this roll 1 and the other, adjacent, roll 4. According to the principle presented in FIGS. 4 and 5, spraying device 3 is situated either opposite to the outer perimeter surface of roll 1, for example so that its area of influence is in the latter half after the nip N in the direction of the roll rotation, i.e. in the 180° sector after the nip, most suitably in the 120° sector after the nip. Calender roll cleaning that is performed by spraying the roll surface is more advantageous than cleaning performed by spraying the web surface. This latter alternative, in which the nozzles of spraying device 3 are aimed at the surface of the web W along the direction of motion of the web, before the nip N, is marked with a broken line.

In the alternative in FIG. 6, the spraying device 3, with nozzles 3*a* divided along the width of the machine or a traversing nozzle in the cross direction, can be used. FIG. 6 also presents the detector devices D1 and D2. Detector device D1 monitors the surface of roll 1 and the data processing device 2 in connection with it processes the observed data and gives a spraying command to spraying device 3 when needed. Correspondingly, it is possible that the spraying command is given at certain phases of the process, according to the commands of the control system of the finishing process, irrespective of whether there is a need for cleaning. This need can be ensured on the basis of the information given by detector device D1 monitoring the surface of roll 1, as is presented above.

When moving to spraying by spraying device 3, the calender also performs other operations, like moving the doctor blade, marked in the figure with reference number 5, to a point in contact with the calender surface located after the spraying point in the rotation direction, and reducing the nip load of the calender nip N.

These operations are performed just a moment before beginning the spraying. The purpose of doctoring is to remove substances possibly sticking to the roll and to remove the possible extra liquid, but not to prevent the flow of the liquid to nip N on roll 1.

The deviations detected by detector device D2 on the web W before the calender nip N are such that they can cause the quality of the surface of roll 1 to deteriorate. Typically these types of deviation are holes, around which agglomerations of coating color have built up in the earlier coating process and have not yet dried up. Additionally, other deviations that can be visually detected by detector device D2, such as dirt spots etc., can cause a spraying command. The soiling of the calender roll can be prevented by a detector device which detects deviations in the web before the web comes in contact with the roll. If the liquid sprayed on the surface of the web and/or roll contains chemicals that prevent the wet coating color or dirt from sticking to the roll, the soiling of the roll can be prevented in advance.

The alternative of FIG. 6 is especially suitable for use in such paper or board finishing lines in which the web, constantly traveling at the running speed, is coated and calendered consecutively, with the calender being situated after the coating station. In this type of off-machine line, in which the machine rolls obtained from the paper or board machine are unwound one after the other and spliced to each other, the problems mentioned in the introduction appear, due to the coating color coming to the point of the continuation splices. In addition, this invention is suitable for such finishing lines in which both the coating station and the calender are situated after the production line, i.e. when an on-line coating machine and on-line calender are part of the same continuously operating production line at the end of the paper and board machine. These production lines do not have problems related to continuation splices, but instead, in these cases, the faults of the papermaking process, such as holes, reach the coating station and the calender.

The invention can be applied in such calenders in which the nip is formed between two rolls, in which case such-roll pairs can exist two in succession, or in multi-nip calenders in which two or more nips in succession are formed between the rolls of a roll stack. In a multi-nip calender the cleaning operations can be advantageously aimed at the first rolls, for example, the first soft-surfaced roll.

Figure 7:
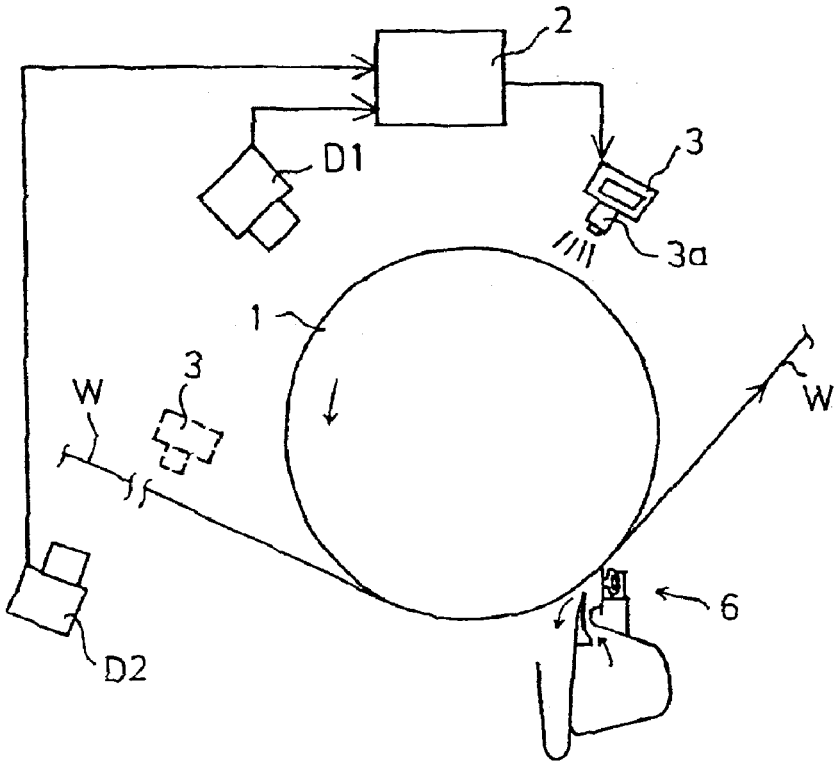
FIG. 7 presents a second embodiment of the invention as a side view in connection with the coating station.

FIG. 7 presents a spraying arrangement according to the invention, applied in the coating station. In the coating station the web W moves in a certain sector guided by the counter roll 1, in which a coating color is spread on its outer surface by coating device 6, which in FIG. 7 is a blade coating device. Coating device 6 doses, in a way known as such, a certain amount of coating color onto the surface of the passing web, per surface area unit of the web.

Before web W comes into contact with counter roll 1, the surface of web W is monitored at a sufficient distance from the coating station by detector device D2, which detects the holes that cause problems in the coating station in the way presented in the introduction of this application. When a hole is detected, spraying device 3 sprays liquid on the surface of counter roll 1 at a suitable stage. Consequently, a coating color patch, which would cause spots on the backside of the web at intervals along the length of the outer perimeter of the roll is not left on the surface of the counter roll. Instead, the liquid dissolves the coating color off and it is transferred rather soon to the web passing by. The spraying can be begun, for example, just before the hole passes through the coating device 6 or immediately after it, when the hole has passed through the coating device 6. If the spraying is timed so that there is liquid on the roll already as the hole comes to the surface of the roll, the sticking of the coating color patch on the wet surface of the roll at the point of the hole can be prevented.

Another possibility is to observe the surface of counter roll 1 with detector device D1 and if coating color patches or other impurities are detected on it, the surface of counter roll 1 is sprayed with liquid by spraying device 3, as a result of which the coating color patch can be transferred to the web. Cleaning performed with both methods produces broke, the amount of which is relatively small, however. It is possible by means of the process control system to determine which part of the web is broke due to this operation, and when it will arrive at a certain point in later processing devices, in which it can be removed so that it does not become part of the final product Detector device D1 or D2 is in contact with data processing unit 2, which handles the information from the detector device and gives commands to the spraying device.

Here also a detector device located before the roll gives the possibility of preventing the soiling of the roll by means of preparatory procedures (spraying).

Also in this alternative, it is possible to spray liquid on the backside of web W instead of on the surface of roll 1 in a situation in which a hole passes through the coating station, in which case the coating color patch can thus be transferred to the dampened web when the corresponding surface comes into contact with the surface of counter roll 1. This spraying device 3 is marked in FIG. 7 with broken lines.

The liquid to be sprayed on the surface of counter roll 1 can contain chemicals that help in repelling the wet coating color patch so that it does not stick to the surface of the counter roll.

Using the same principles as mentioned above in connection with the calender, the cleaning or preventive action can here also be directed at a certain zone in the web in the width direction either by activating only one or more nozzles 3*a* of the nozzle series or by bringing a traversing nozzle to the right place in the cross direction of the machine.

The surface of the web W that comes against counter roll 1 can already have been coated in a previous coating station in the situation in FIG. 7, in which case the station in FIG. 7 is the second coating station. The spreading of liquid in a sufficient quantity ensures that the coating does not stick to the roll, because a thick enough liquid layer prevents the sticking.

Also in the situation in FIG. 7 it is possible to perform whole-width cleaning by spraying liquid at such a phase that is appropriate for the process, i.e. when the paper or board passing through roll 1 at the moment of cleaning will end up as waste in any case.

Figure 8:
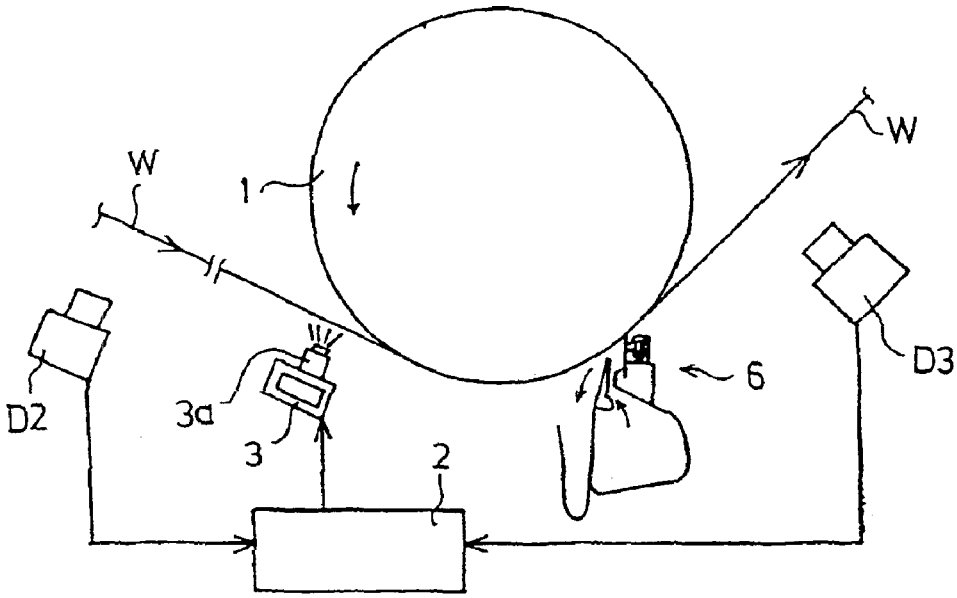
FIG. 8 presents a third embodiment of the invention as a side view in connection with the blade coating station.

FIG. 8 presents a side view of a coating station in which the spraying is applied in a different way. In this case, a liquid is sprayed onto the side of the web W that will be coated later by coating device 6. In this case, the uncoated web W is inspected by the detector device D2 before the coating point and/or the coated web W is inspected by the detector device D3 after the coating point. The spraying device 3 is located before the coating device 6 and is pointed towards the surface of the web that is to be coated If the detector device D2 is used before the coating point, the spraying device 3 will be located after this detector device D2.

When a deviation is detected in web W, which, detected by detector device D2 before the coating point will be a deviation disturbing the coating process, or detected by detector device D3 after the coating point will be a sign of a continuous disturbance at the coating station, the spraying device 3 will start spraying on the still uncoated surface of the paper. This exploits the well-known phenomenon that coating color will not stick if the base paper is wet. If the deviation detected by the detector D2 before the coating point is a hole or, in the case of an off-line coating machine, also a splice, liquid can be sprayed onto this point so that the coating color does not stick to the point in question and cause the problems presented in the introduction to this application as it passes through the calender, for example. If, on the other hand, a continuous disturbance is detected by the detector device D3 after the coating point, such as a blade streak resulting from a particle left under the coating blade, the spraying will be continued until the particle has been washed away, which can be detected by the same detector device D3. In the case of holes, streaks and other deviations restricted to a certain point in the cross direction of the web, restricted spraying can be applied by the spraying device 3 to the corresponding point, in which case one or more switched-on nozzles 3*a* in the nozzle series can be used, or a traversing nozzle can be driven to the corresponding point in the cross direction of the machine. In the case of a whole-width splice, whole-width spraying is used simultaneously. Thus, a nozzle series covering the whole web width is the more economical option, because it allows the implementation of both restricted spraying in a certain zone and spraying that is simultaneously directed at the whole web width, in accordance with the nature of the deviation. Spraying can also be carried out according to a profile by controlling adjacent nozzles 3*a* separately.

The liquid used can be water, by which it is possible to prevent the wet coating color from sticking to the paper or to dissolve away a particle from under the blade. As there is liquid on the surface of the paper, the blade will not bum at the uncoated point during blade coating and the web tension will not be changed.

The dirt that collects on the roll is moistened, in one advantageous embodiment of the invention, by a liquid whose boiling point is higher than the roll temperature in process conditions. Thus, the temperature cracking of the roll is avoided. The dirt on the roll is then removed by methods known as such, which is explained in this application.

The points treated in the above-mentioned ways can be removed from production as broke at a later stage of the finishing process, and the travel of these web areas can be monitored by means of a process control system.

Furthermore, the detector devices D2 and/or D3 in the alternative depicted in FIG. 8 are connected to the data processing unit 2 which processes the information from the detector device and issues instructions to the spraying device 3 to ensure its correctly-timed functioning.

The most suitable device for use as the detector device D1, D2 or D3 will be a device that is capable of visually observing a certain-sized area on the surface of roll 1 or web W and storing the observations for realtime processing. The device can be a camera equipped with an image sensor, that senses electromagnetic radiation, such as a CCD camera. A detector device can also be an IR camera that measures infrared wave lengths, whereas on the other hand a device that makes visual observations will measure the visible light if one detector device is not sufficient to observe the whole width of the web or the roll sufficiently accurately, a number of devices can be arranged side by side, so that each will observe a zone of a certain width A detector device is not necessarily based on visual detection, but the presence of a deviation on the surface of a roll or web can be identified by some other fault detection method, for example by web fault detection.

Figure 9:
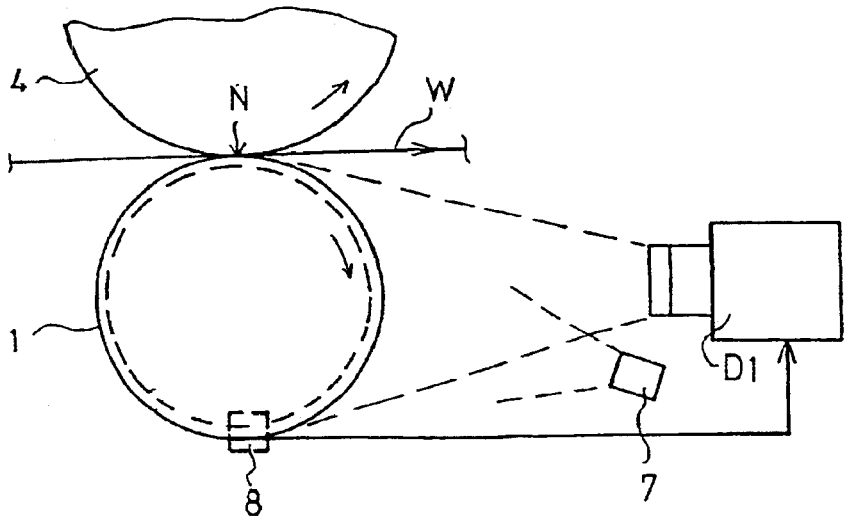
FIG. 9 is a schematic drawing of a side view of a monitoring system related to the invention.

The foregoing has dealt with the detection of deviations and the taking of measures by spraying performed on the web or the roll, focusing on different spraying alternatives and spraying timing with respect to the paper finishing process in general. The following description gives a more detailed explanation, with reference to FIGS. 9 and 10, of the possibilities of performing observation of the surface of roll 1, for example a calender roll.

Figure 10:
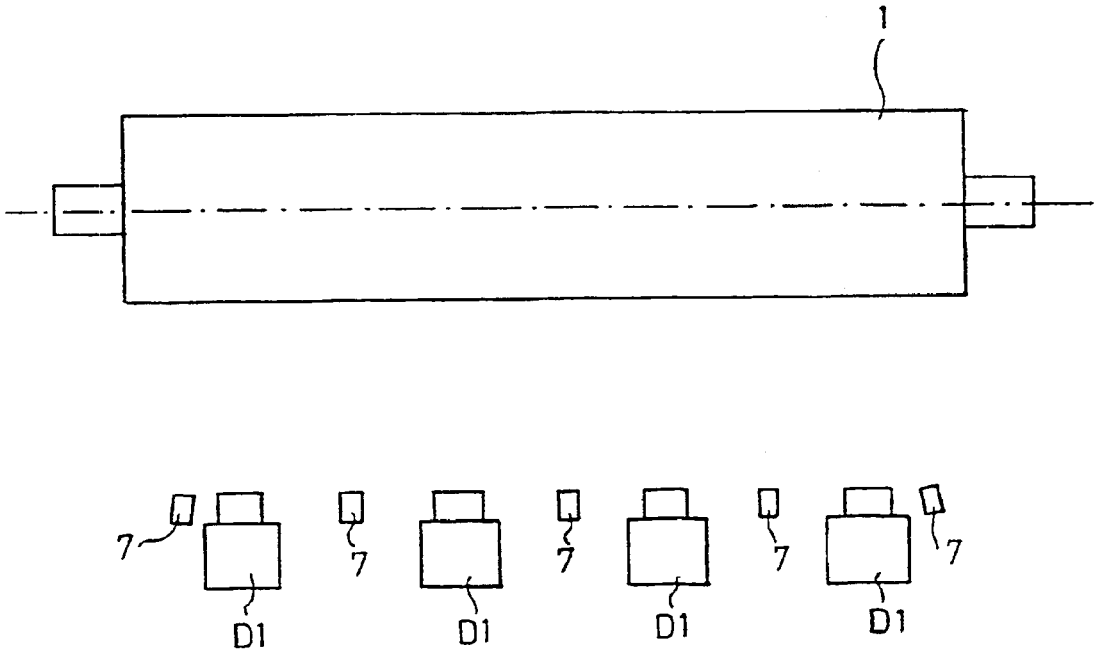
FIG. 10 presents the system of FIG. 9 as a plan view.

The detector device D1 can be a CCD camera that measures the polymer surface of the calender roll. The camera continuously measures the intensity of the light reflecting from the roll surface, which light can be produced by a special light source 7. FIG. 10 shows a number of detector devices D1, each mounted so as to observe a roll zone of a certain width; i.e. the devices are located at suitable intervals in the axial direction. Thus, good resolution is obtained and even small deviations can be detected. Correspondingly, there are several light sources, for example, each detector device D1 has its own, which illuminate the observation zone of each detector device.

As data on the roll rotation speed is brought to the CCD camera processor by, for example, pulse sensor 8, the camera can be used to make a map in the processor memory of the roll surface during one rotation of the roll, i.e. a two dimensional image. During each roll rotation or at certain intervals, e.g. after ten rotations, this map is compared in the data processing unit 2 with the rotation map obtained in the previous rotation. Thus, it is possible to notice if some point on the roll suddenly changes its color due, for example, to a coating color patch or a piece of paper.

This detection principle can be used not only in the calender roll, but also in that alternative of the embodiment of FIG. 7 in which the surface of the counter roll 1 is inspected in order to detect coating color patches.

The data processing unit 2 has a data transfer connection with the spraying device 3 in the manner referred to in connection with FIGS. 6–8.

As has been mentioned in the foregoing, in on-line processes in which the calender is in the same production line as the paper machine it is not possible to eliminate web faults in the rewinder.

The following is an explanation of an alternative designed for this kind of production line, for observing the surface of a roll or web in a calender, for example.

The use of a web fault detection system in roll protection is complicated by the fact that it is not exactly known what the received fault data tells us about how harmful the phenomenon observed on the web will be to the roll surface. The lack of this information easily leads to a situation in which the calender's control system over-reacts to the web's fault data, so that the calender's possible protective measures (cleaning, rapid openings, etc.) are activated nearly the whole time and disturb the actual production, or, as in this invention, the spraying is activated unnecessarily often. In a second extreme case there is also the possibility that the calender's control system will not react at all to the fault information, in order not to disturb production, in which case there is in practice no roll protection.

The problem related to the condition monitoring of roll 1 in roll protection is detection after the event. The event leading to damage should begin before it can be detected. In such a case, it can happen that when the roll protection measures begin, the cover has already been damaged, and even rapid measures cannot do more than save from additional problems (production quality problems, safety risks).

Figure 11:
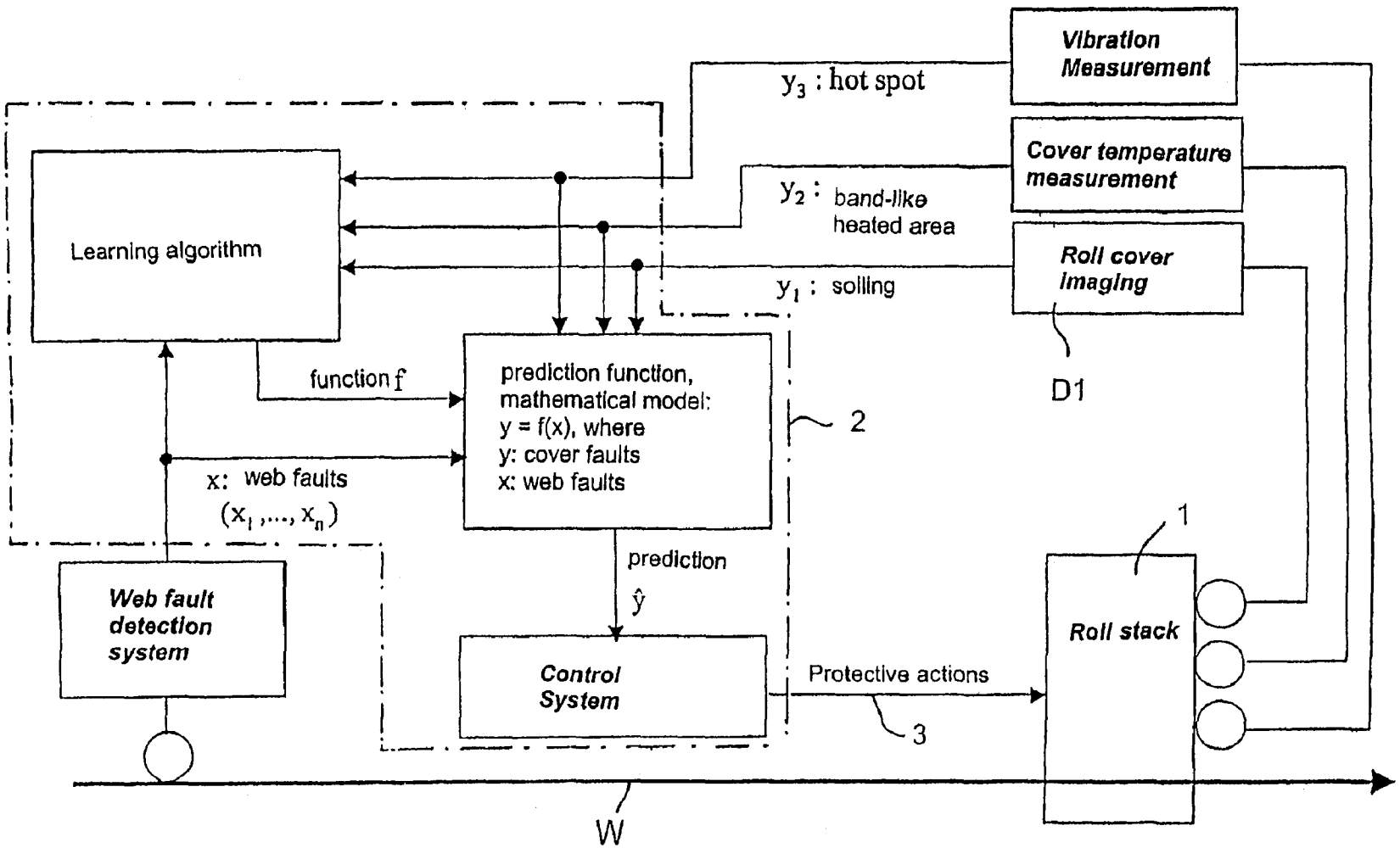
FIG. 11 presents a block diagram of an advanced system for performing detection.

FIG. 11 is a schematic presentation of the principle of the method. The method exploits the above-described system used for web fault detection and systems used in the condition monitoring of the roll cover which are similar to present systems. The innovation in the invention is the combining of these systems into an automatically functioning, deductive machine which functions as an automatic monitoring data processing unit 2. The deductive machine comprises equipment and a learning deductive or computation algorithm which is taught to predict the data for the roll cover condition monitoring system on the basis of the data obtained from the web fault detection system: whether, on the basis of the web fault data, it is possible to predict, for example, the vibration measurement "hot spot" observation made by observing the surface of roll 1, the band-like heated area on the roll cover observed by the IR camera or the soiling on the roll surface witnessed by the CCD camera, or whether the run will probably flow without cover monitoring alarms. The teaching of the deductive machine takes place by some known algorithm or a new algorithm to be used in the implementation of machine intelligence.

After the learning stage, a system according to the invention knows which fault information obtained from the web fault detection system may cause real harm to the roll cover. A taught system can initiate protective measures already on the basis of classified fault data obtained from the fault detection system, without needing to wait for observation of the beginning of roll damage or soiling by the detector device carrying out the condition monitoring of the rolls. The measures in this invention are spraying by spraying device 3 on the surface of web W or roll 1. The protective measures are begun only if necessary. If the deductive machine has not learnt that the type of fault observed is normally followed by an alarm concerning the roll condition monitoring, the calender control system does not begin protective measures.

Thus it will be possible to avoid the unnecessary disturbance of production caused by protective measures.

At the learning stage of the system, information is gathered on the influence of web faults in the creation of phenomena causing roll cover faults. Then possibly the creation of some cover faults begins to occur. The development of these faults can be stopped, however, at their early stage because the cover condition monitoring is on and triggers the roll protective measures, even if late in comparison with the detection of web faults.

The leaning can be implemented either as a separately selected learning mode or as continuous learning. In the latter case, the system can continually improve its performance by learning from new situations.

In the invention, a system designed for web fault detection, similar to present systems, can be improved if necessary so that the detector device established for the reception of electromagnetic radiation will use not only the visible light (e.g. CCD cameras) but also infrared wave lengths—then its possibilities of observing damp coating color patches will improve.

In monitoring the soiling of rolls (in imaging by the CCD camera) it is possible to exploit the fact that wet coating color sticks on the calender rolls most likely in the first nips. Then, after the pigment coating of the paper, CCD camera monitoring is needed only in the calender's first nips. If the locations of the cameras can be chosen suitably so that the image contains not only the roll but also the nip area, the invention can exploit both the roll surface image and the web break automatics—if the image processing algorithm does not observe the web in the nip area, a web break has occurred.

The invention is not limited only to the embodiments presented in FIGS. 4–11, but it can be adapted within the framework of the inventive idea presented in the patent claims. The calenders in which the invention can be used are not limited to the calender presented in FIG. 6. Blade coating is presented in FIGS. 7 and 8, but the invention can be used also in connection with other coating methods, such as film transfer coating, even if blade coating is more problematic due to the coating principle, such as substances remaining on the blade which can cause streaks. The type of detector is not limited by the foregoing, although devices observing the surface without touching it and based on the measurement of electromagnetic radiation (visible light, IR area), which are able to monitor large surfaces simultaneously and are equipped with good image processing possibilities are indeed more advantageous. Then the detection is based on the reception of visible light or the reception of other electromagnetic radiation grades such as IR. For example, information on deviations in the calender roll can be gained by analysis based on vibration measurements carried out by acceleration sensors.

In the spreading of liquid, spraying is advantageous as a non-contact spreading method, in which case a certain amount of the liquid is dosed from the nozzles onto the surface of the roll or web, but it could be possible to conceive of the spreading on the surface of roll 1 occurring also by an element which touches the surface of the roll and transfers liquid onto the surface of the roll.

Figure 12:
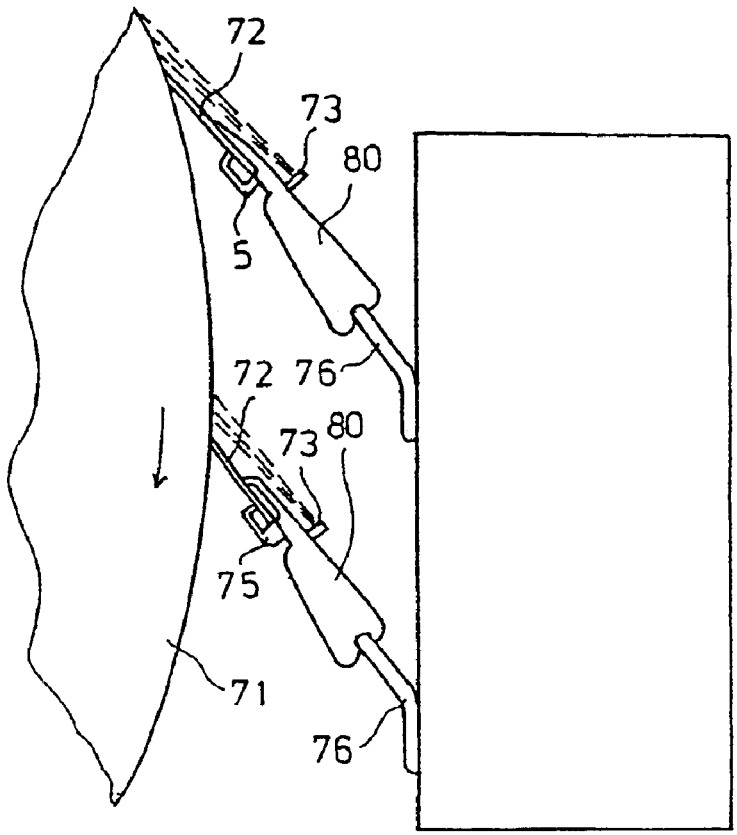
FIG. 12 presents a side view of one application of a device according to the invention.

FIG. 12 presents roll 1, the surface of which is cleaned with two doctor blades. Doctor blades 72 can be either similar to or different from each other. Doctor blades 72 can also be in use simultaneously or separately, in other words, the motion of a doctor blade in/out of contact with the surface of the roll is controllable independently of the other doctor blade. Doctor blades 72 can also be loaded with loads of different magnitude in order to achieve the wanted result. Doctor blade 72 continues advantageously along the whole width of the roll and is attached to the blade holder 75.

The stem 80 of the doctor holds a liquid container, through which a liquid that prevents or reduces soiling can be pumped onto the surface of roll 71 from feed members 73, that can be, for example, nozzles made for spraying liquid. The nozzles are situated in the frame of the doctor and are directed so that they spray liquid on the surface of the roll in the direction of rotation, before the corresponding blade. The direction of rotation is indicated with an arrow in the figure.

The sprayed liquid can be such that changes the surface of roll 71 to be more hydrophilic compared to what it was before treatment with the said liquid. The sprayed liquid is chosen so that a minimum of adhesion force is reached between the surface of roll 71 and the substance attempting to stick onto the surface, in which case soiling is notably reduced or entirely prevented.

Figure 13:
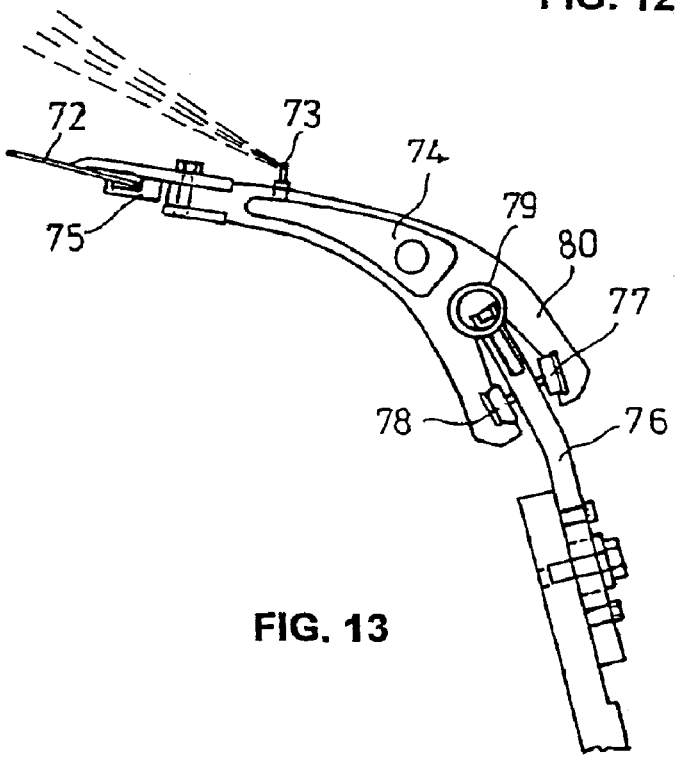
FIG. 13 presents a cross section of a doctor blade and its surrounding structure.

FIG. 13 presents doctor blade 72 used for cleaning the roll and the structure surrounding it as a cross-section. Doctor blade 72 is attached to blade holder 75. Frame 80 of the doctor holds liquid container 74, through which a liquid that prevents or reduces soiling can be pumped to be sprayed onto the surface of the roll by feed members 73. Frame 80 of the doctor is attached to a base 76 in such a way that the frame 80 can be adjusted to a suitable angle by controlling members 77 and 78 and bearings 79. Controlling member 77 is for loading pressure and controlling member 78 is for opening pressure.

EXAMPLE

The surface material (Duraheat, Durasoft) of the roll was treated with aqueous solutions of surface active substances. The experiments used a cationic surface active substance (Quadrilan AT), anionic surface active substance (Perlankrol EP 36) and non-ionic surface active substance (Monolan 8000/E80). In all cases the cleaning result was good.

While performing tests in laboratory conditions on the surfaces treated in the above-mentioned way, it was discovered that their angle of contact was about 50°, in which case the roll surface had become somewhat more hydrophilic.

The invention is not limited to what is stated above, but it can vary in accordance with the Claims. The materials of the doctor blades can be different. The liquid sprayed on the surface of the roll can be any kind of liquid substance, which eases cleaning the surface of the roll and/or changes the surface properties of the roll in the desired direction. The main point in this invention is, that by using at least two doctor blades the cleaning result of the calender roll can be adjusted to be suitable.

The following presents the Claims, within the inventive idea of which the details can vary or deviate from the above-presented demonstrative examples.

What is claimed is:

1. A method for cleaning and maintaining a set of rolls of a paper machine or board machine, wherein the set of rolls is equipped with a soiling monitoring apparatus, and a controllable cleaning device, which is controlled by a control system, the method comprising the steps of:

monitoring the surface of the web by a fault detection system, and delivering the detected information to the control system;

detecting and localizing the soiled part of a roll by the soiling monitoring apparatus; and delivering information on the detection and location of soiling on the rolls gathered by the soiling monitoring system to the control system of the cleaning device, and according to a control command of the control system, controlling the cleaning device to remove the detected soiling from the roll by spreading with liquid at least part of the width of the roll or web during the running of the machine at the same time as the web runs over the surface of said roll, and carrying away the spread liquid and possible extra substances with the web as the web runs over the roll.

2. The method of claim 1 wherein the cleaning device continues its cleaning action until the soiling monitoring apparatus detects that the soiling has been removed.

3. The method of claim 1 wherein the soiling of the roll is detected and localized by a measurement based on laser radiation and/or on the basis of a vibration measurement and/or by a CCD camera.

4. The method of claim 1 wherein the cleaning device is transferred to the soiled part of the roll.

5. A method for cleaning and maintaining a set of rolls of a paper machine or board machine, wherein the set of rolls is equipped with a soiling monitoring apparatus, and a controllable cleaning device, which is controlled by a control system, the method comprising the steps of:

monitoring the surface of the web by a fault detection system, and delivering the detected information to the control system;

detecting and localizing the soiled part of a roll by the soiling monitoring apparatus; and delivering information on the detection and location of soiling on the rolls gathered by the soiling monitoring system to the control system of the cleaning device, and according to a control command of the control system, controlling the cleaning device to remove the detected soiling from the rolls, wherein the cleaning device cleans all the rolls of the set of rolls in turn.

6. A method for maintaining the surface of a roll of a paper machine or board machine, over which a web passes in a paper or board machine or paper or board finishing machinery executing a paper or board production process or a finishing process, comprising the steps of:

continuously monitoring the surface of the web and/or the roll automatically in order to detect deviations;

if a deviation is detected on the web or on the surface of the roll in the automatic monitoring, momentarily spreading with liquid at least part of the width of the surface of the roll or the web during the running of the machine, at the same time as the web runs over the surface of said roll; and allowing die spread liquid and possible extra substances to be carried away with the web that runs over the surface of the roll.

7. The method of claim 6 wherein the part of the web which contains the liquid and the possible extra substances is removed later in the process as broke.

8. The method of claim 6 wherein the liquid is spread as a routine operation.

9. The method of claim 8 wherein the spreading is scheduled to those moments when the web running over the roll will become broke due to some phase in the process.

10. The method of claim 9 wherein the phase in the process is selected from the group consisting of a roll change at a reel and changing the grade of paper or board in production.

11. The method of claim 8 wherein the spreading is performed automatically according to a command given by a process control system.

12. The method of claim 8 wherein the spreading is performed along the whole width of the web onto the surface of the roll or the web.

13. The method of claim 8 wherein the method is used to maintain at least one calender roll in a calender or to maintain one coating station counter roll in a coating station.

14. The method of claim 6 wherein the spreading of the liquid onto the surface of the roll or the web is performed as a result of deviation information received from monitoring the web or from monitoring the surface of the roll.

15. The method of claim 14 wherein the liquid is spread on the surface of the roll, or before the roll in the running direction of the web on the surface of the web which will come into contact with the roll.

16. The method of claim 15 wherein the method is used in a calender to maintain at least one calender roll or in a coating station to maintain the counter roll of the coating station.

17. The method of claim 14 wherein the method is used in a coating station to prevent deviations of the coating process from traveling to the rolls with which the web will later come into contact, in which case the liquid is spread in the running direction of the web before the spreading point of the coating color, onto that surface of the web that receives the coating color.

18. The method of claim 17 wherein the liquid is spread by spraying.

19. The method of claim 17 wherein by means of the cleaning liquid the coating color is prevented from sticking at the spreading point to said surface of the web in certain areas of the web.

20. The method of claim 17 wherein a continuous fault in the surface of the web as a result of a deviation in the spreading point of the coating color is removed with the liquid.

21. The method of claim 6 wherein a detector device based on receiving electromagnetic radiation and/or a web fault detection system is/are used in the automatic monitoring of the web or the surface of the roll.

22. The method of claim 21 wherein two-dimensional surface information is recorded at certain intervals by the detector device and the recorded surface information is compared to the information received of previous recordings for detecting deviations.

23. The method of claim 22 wherein the two-dimensional surface information comprises an image of the same part of the shell surface of the roll over the entire length of one revolution and said image is compared to the information received of previous recordings for detecting deviations.

24. The method of claim 22 wherein the recorded moments are synchronized with the rotation motion of the roll.

25. The method of claim 23 wherein rotation motion of the roll is provided by a rotation velocity detector.

26. The method of claim 6 wherein in addition to automatic monitoring of the surface of the roll, information received from a web fault detection system is used.

27. The method of claim 26 wherein automatic monitoring of die surface of the roll and the web fault detector system are combined into an automatically operating deductive machine.

28. The method of claim 26 wherein monitoring of the surface of the roll is performed by imaging, temperature measurement or vibration measurement or by any combination thereof.

29. The method of claim 27 wherein the automatically functioning deductive machine holds a deduction or computation algorithm capable of learning.

30. The method of claim 6 wherein it is used for maintaining a roll equipped with a flexible roll cover.

31. The method of claim 6 wherein it is used in a paper machine or board machine or in paper or board finishing machinery, in which a coating station and a calender are arranged in the same line so that the web continuously runs from the coating station to the calender.

32. The method of claim 30 wherein it is used in a paper machine or board machine in which a coating station and a calender are arranged in the same line after the paper machine or board machine so that the web produced by the paper machine or board machine continuously runs through the coating station to the calender.

33. The method of claim 6 wherein, in the method, a liquid is fed onto the surface of the roll and the surface of the roll is cleaned with at least two doctor blades, situated one after the other in the direction of rotation of the roll, and that the surface of the roll is cleaned with the doctor blades, which are fitted against the surface of the roll independently of one another.

34. The method of claim 33 wherein the independent movement of each doctor blade to and away from the surface of the roll and/or the feed of the liquid is/are adjusted based on the information received from a fault detection device.

35. The method of claim 33 wherein the liquid is fed before the first doctor blade in the direction of rotation of the roll and/or between the first and the second doctor blade.

36. The method of claim 33 wherein the surface of the roll is fed with liquid which changes the surface of the roll to be more hydrophilic.

37. The method of claim 33 wherein the boiling point of the liquid is higher than the temperature of the roll surface in process conditions.

38. The method of claim 20 wherein the continuous fault which is removed is a coating color streak.

39. An apparatus for cleaning a roll of a paper machine or board machine comprising:

a cleaning device for cleaning the roll;

a control system for controlling the cleaning device;

a soiling monitoring apparatus for detecting the soiled part of the roll, and arranged to deliver the detected information to the control system; and a fault detection system positioned to detect faults in the web and arranged to deliver the detected information to a control system, the control system being operable to control the cleaning device to remove soiled parts of the roll, wherein the cleaning device comprises a liquid spreading device and an arrangement far carrying away liquid and possible extra substances with the web as it runs over the surface of the roll.

40. The apparatus of claim 39 wherein the soiling monitoring apparatus comprises a measuring unit and a control unit.

41. The apparatus of claim 40 wherein the measuring unit of the soiling monitoring apparatus is a measuring device based on laser radiation and/or a measuring device based on vibration measurement.

42. The apparatus of claim 39 wherein the cleaning device comprises at least one of the following doctor actuators: a laser doctor, a blade a washing doctor and a blow doctor.

43. The apparatus of claim 39 wherein the cleaning device comprises at least one doctor blade, and wherein the roll is a calender roll within a calender, and wherein the angle between the doctor blade and the calender roll, and/or the doctoring pressure of the doctor blade against the calender roll is adjustable.

44. The apparatus of claim 39 further comprising a plurality of rolls in a roll stack, wherein a traversing cleaning device is arranged on both sides of the roll stark.

45. An apparatus for cleaning a roll of a paper machine or board machine comprising:

a cleaning device for cleaning the roll;

a control system for controlling the cleaning device;

a soiling monitoring apparatus for detecting the soiled next of the roll, and arranged to deliver the detected information to the control system; and a fault detection system positioned to detect faults in the web and arranged to deliver the detected information to a control system, the control system being operable to controlling the cleaning device to remove soiled parts of the roll, wherein the cleaning device comprises a laser doctor comprising:

a laser light source; and a lens in which the power and direction of the laser beam are adjustable.

46. An apparatus for cleaning a roll of a paper machine or board machine comprising:

a cleaning device for cleaning the roll;

a control system for controlling the cleaning device;

a soiling monitoring apparatus for detecting the soiled part of the roll, and arranged to deliver the detected information to the control system; and a fault detection system positioned to detect faults in the web and arranged to deliver the detected information to a control system, the control system being operable to control the cleaning device to remove soiled parts of the roll, wherein the cleaning device has a doctor blade which comprises blade parts that can be placed in operation in zones for doctoring the rolls of a set of rolls over the whole length or part of the length of said rolls.

47. An apparatus far cleaning a roll of a paper machine or board machine comprising:

a cleaning device for cleaning the roll;

a control system for controlling the cleaning device;

a soiling monitoring apparatus for detecting the soiled part of the roll, and arranged to deliver the detected information to the control system;

a fault detection system positioned to detect faults in the web and arranged to deliver the detected information to a control system, the control system being operable to control the cleaning device to remove soiled parts of the roll; and a plurality of rolls in a roll stack, and wherein the cleaning device is arranged to traverse in the vertical and horizontal directions along the whole dimension of the roll stack.

48. The apparatus of claim 47 wherein the traversing cleaning device is connected to a hoist.

49. An apparatus for maintaining the surface of a roll in a paper machine or board machine performing a paper or board production process or a finishing process or in paper or board finishing machinery, which includes members for guiding a web over the surface of a roll, the apparatus comprising:

at least one automatic monitoring device which is arranged to continuously monitor the web and/or the surface of the roll;

a data processing device which is connected to the monitoring device;

a liquid spreading device which is connected to the data processing device and arranged to spread a liquid onto the surface of the roll or the web based on commands given by the data processing device; and an arrangement that enables the liquid and possible extra substances to be carried away with the web that runs over the surface of the roll.

50. The apparatus of claim 49 further comprising at least two doctor blades which are situated one after the other in the direction of rotation of the roll, and which can be fitted independently of one another against the roll to be cleaned.

51. The apparatus of claim 49 further comprising:

at least two doctor blades which can be fitted against the roll; and a fault detection device, which is arranged to adjust the movement of the doctor blades to the surface of the roll, away from the surface of the roll and/or the feed of liquid onto the surface of the roll.

52. The apparatus of claim 49 further comprising:

a first doctor blade; and a second doctor blade, wherein the doctor blades can be fitted against the roll, wherein the feed of the liquid is arranged before the first doctor blade in the direction of rotation of the roll and/or between the first and the second doctor blade.

53. The apparatus of claim 52 wherein each of the first doctor blade and the second doctor blade have portions defining a frame, and wherein feed members for feeding the liquid are arranged in the frame of at least one of the doctors.

* * * * *

UNITED STATES PATENT AND TRADEMARK OFFICE

CERTIFICATE OF CORRECTION

PATENT NO. : 6,905,573 B2
DATED : June 14, 2005
INVENTOR(S) : Mäenpää et al.

It is certified that error appears in the above-identified patent and that said Letters Patent is hereby corrected as shown below:

Column 12,
Line 58, "width A" should be -- width. A --

Column 15,
Line 26, "roll 1," should be -- roll 71, --

Column 18,
Line 23, "die surface" should be -- the surface --
Line 40, "The method of claim 30" should be -- The method of claim 31 --

Column 19,
Line 41, "next of the roll" should be -- part of the roll --

Column 20,
Line 4, "far cleaning" should be -- for cleaning --

Signed and Sealed this

Ninth Day of August, 2005

JON W. DUDAS
*Director of the United States Patent and Trademark Office*